US008418752B2

(12) United States Patent
Otahal et al.

(10) Patent No.: US 8,418,752 B2
(45) Date of Patent: Apr. 16, 2013

(54) PLATE HEAT EXCHANGER HAVING A TURBULENCE GENERATOR

(75) Inventors: Klaus Otahal, St. Florian (AT); Josef Hofer, Schneegattern (AT)

(73) Assignee: Mahle International GmbH, Stuttgart (DE)

( * ) Notice: Subject to any disclaimer, the term of this patent is extended or adjusted under 35 U.S.C. 154(b) by 1114 days.

(21) Appl. No.: 12/285,306

(22) Filed: Oct. 1, 2008

(65) Prior Publication Data

US 2009/0095456 A1 Apr. 16, 2009

(30) Foreign Application Priority Data

Oct. 4, 2007 (AT) ..... A 1566/2007

(51) Int. Cl.
*F28F 13/12* (2006.01)
*F28F 3/00* (2006.01)

(52) U.S. Cl.
USPC ..... 165/109.1; 165/166

(58) Field of Classification Search ..... 165/166, 165/152, 183, 153, 109.1
See application file for complete search history.

(56) References Cited

U.S. PATENT DOCUMENTS 2,360,123 A * 10/1944 Gerstung et al. ..... 165/298
3,521,707 A * 7/1970 Brown ..... 165/152
3,542,124 A * 11/1970 Bridgnell et al. ..... 165/166
3,612,494 A 10/1971 Toyama et al.
3,768,149 A * 10/1973 Swaney, Jr. ..... 29/527.2
4,146,090 A * 3/1979 Nakayama et al. ..... 165/166
4,273,183 A * 6/1981 Altoz et al. ..... 165/277
4,804,041 A * 2/1989 Hasegawa et al. ..... 165/166
5,107,922 A * 4/1992 So ..... 165/109.1
5,625,229 A * 4/1997 Kojima et al. ..... 257/712
RE35,890 E * 9/1998 So ..... 165/109.1
(Continued)

FOREIGN PATENT DOCUMENTS

DE 29824920 U1 7/2003
EP 1172625 A2 1/2002
(Continued)

OTHER PUBLICATIONS

English Abstract of JP56130594A, pp. 1-2.*
(Continued)

*Primary Examiner* — Brandon M Rosati
(74) *Attorney, Agent, or Firm* — Laurence A. Greenberg; Werner H. Stemer; Ralph E. Locher

(57) ABSTRACT

A plate heat exchanger with a plurality of separating walls stacked one above the other, which alternatingly define a first and second flow space for a first and second medium, includes at least one turbulence generator being positioned in at least one flow space, which comprises a plate with a number of parallel-running band-like rows of alternating elevations and depressions mutually connected by bridges, where the elevations and depressions of each row are shifted with respect to each immediately adjacent row, and where each row is provided with at least one transition area for the medium to pass to the immediately adjacent row, such that the depressions of each row are flow-connected with the immediately adjacent elevations of at least one immediately adjacent row. To achieve high heat transfer performance in a simple manner it is provided that the bridges of each row are essentially parallel and equally inclined relative to the separating walls, with an acute angle being formed between a separating wall and the bridges.

7 Claims, 2 Drawing Sheets

U.S. PATENT DOCUMENTS

| | | | | |
|---|---|---|---|---|
| 6,032,503 | A * | 3/2000 | Grippe | 72/186 |
| 6,138,354 | A * | 10/2000 | Kobayashi et al. | 29/890.049 |
| 6,247,527 | B1 * | 6/2001 | Paulman | 165/152 |
| 6,273,183 | B1 * | 8/2001 | So et al. | 165/109.1 |
| 6,415,855 | B2 * | 7/2002 | Gerard et al. | 165/166 |
| 6,598,669 | B2 * | 7/2003 | Paulman | 165/152 |
| 6,675,878 | B2 | 1/2004 | Haasch et al. | |
| 6,901,995 | B2 * | 6/2005 | Yamaguchi et al. | 165/152 |
| 6,932,153 | B2 * | 8/2005 | Ko et al. | 165/110 |
| 7,063,047 | B2 * | 6/2006 | Reinke et al. | 122/31.1 |
| 7,686,070 | B2 * | 3/2010 | Chu et al. | 165/109.1 |
| 2001/0011586 | A1 * | 8/2001 | Yamaguchi et al. | 165/109.1 |
| 2002/0011331 | A1 | 1/2002 | Lehman et al. | |
| 2002/0162646 | A1 * | 11/2002 | Haasch et al. | 165/109.1 |
| 2003/0066635 | A1 * | 4/2003 | Rhodes et al. | 165/148 |
| 2008/0011464 | A1 * | 1/2008 | Oofune et al. | 165/157 |
| 2011/0189525 | A1 * | 8/2011 | Palanchon et al. | 429/120 |

FOREIGN PATENT DOCUMENTS

| | | | |
|---|---|---|---|
| EP | 1241426 | B1 | 9/2004 |
| EP | 1918668 | A1 | 5/2008 |
| GB | 1288227 | A | 9/1972 |
| JP | 56130594 | A * | 10/1981 |
| WO | 0063631 | A3 | 1/2001 |

OTHER PUBLICATIONS

European Search Report dated Feb. 2, 2010.

* cited by examiner

PLATE HEAT EXCHANGER HAVING A TURBULENCE GENERATOR

BACKGROUND OF THE INVENTION

The invention relates to a plate heat exchanger with a plurality of separating walls stacked one above the other, which alternatingly define a first and second flow space for a first and second medium, a turbulence generator preferably made of sheet metal being positioned in at least one flow space, which generator comprises a plate with a number of parallel-running band-like rows of alternating elevations and depressions mutually connected by bridges, where the elevations and depressions of one row are shifted with respect to the immediately adjacent row, and where each row is provided with at least one transition area for the medium to pass to the immediately adjacent row, such that the depressions of each row are flow-connected with the immediately adjacent elevations of at least one immediately adjacent row.

Plate heat exchangers, especially oil/water heat exchangers consist of a plurality of plates stacked one above the other, forming alternating layers through which a first and second medium flow, for example oil and water. The upwardly bent rim of the plates encloses each layer of the heat exchanger and extends to the rim of the next plate, thus permitting a tight seal against the outside to be achieved by brazing. Inflow of the media occurs through openings in the corner areas of the predominantly rectangular plates.

It is known in the art to furnish the individual units of heat exchangers with internal turbulence generating features, i.e., turbulence generators, to improve heat exchange characteristics of the heat exchanger. In general these turbulence generators induce turbulent flow in the medium flowing through the heat exchanger, thus improving the heat exchange characteristics of the heat exchanger.

In a known type of oil/water heat exchanger turbulence sheets are disposed between individual plate layers, which are brazed to the respective upper and lower faces of adjacent plates during the manufacturing process. These turbulence sheets achieve the following essential objectives:

- enlarging the surface for better heat transfer;
- generating swirl in the flowing media for better heat transfer;
- extending the flow path;
- supporting the thin plates against applied pressure;
- supporting the thin plates against deformation during the braze-welding process.

The turbulence sheets are thus core elements of the heat exchanger and largely determine heat transfer performance, flow resistance of both media and mechanical pressure resistance. In the design of an oil/water heat exchanger the following objectives must be met:

- maximum heat transfer performance from the oil system to the coolant;
- small pressure difference on the oil side;
- small or suitably adapted pressure difference on the coolant side;
- small dimensions;
- a minimum of material required;
- simple structure;
- good pressure resistance under increasing pressure.

The principal objective of high heat transfer performance in practice runs counter to almost all other objectives. A narrow structure of the turbulence sheets, for instance, will achieve high swirl and thus good heat transfer, but will also entail high pressure difference. Heat transfer performance will also increase with the space used (number and size of plates), but the latter is to be kept at a minimum for cost and volume reasons. An essential aspect of the turbulence sheets is also their manufacture. Perforated aluminum sheets are usually used, which are formed by a rolling or die-cutting process.

DESCRIPTION OF PRIOR ART

From EP 1 241 426 B1 there is known a plate heat exchanger with a plurality of parallel separating walls, which alternatingly define a flow space for a first and second medium. In the flow spaces of one of the media a turbulence generator is provided, which consists of a structured metal sheet with parallel rows of alternating elevations and depressions. Adjacent rows are shifted relative to each other, permitting the medium to flow from row to row. The elevations and depressions are connected by bridges inclined against each other, the turbulence generator having an essentially trapezoidal cross-section between the bridges. To achieve optimum heat transfer the turbulence generator must be in contact with neighboring separating walls in the area of the elevations and depressions. This however requires the turbulence generator to be precision-manufactured for each application. It is disadvantageous that different individual turbulence generators have to be manufactured for heat exchangers having different distances between the separating walls. Furthermore it has been found that these known turbulence generators do not in every instance guarantee optimum heat transfer.

DE 298 24 920 U1 discloses a heat exchanger for heat exchange between gaseous media, consisting of stacked profile elements, where the stacked profile elements alternatingly are disposed at an angle to the longitudinal direction of the heat exchanger and where the profile elements have smooth surfaces and are not provided with additional structures. The profile elements may have saw-tooth shape or a trapezoidal, fold-shaped or wave-shaped profile. Such profile elements will not ensure optimum heat transfer.

SUMMARY OF THE INVENTION

It is an object of the present invention to avoid the above mentioned disadvantages, to improve heat transfer of a plate heat exchanger in a simple way and to keep manufacturing cost at a minimum.

The invention achieves this object by providing that the bridges of each row are essentially parallel and are equally inclined against the separating walls, an acute angle being formed between separating wall and bridges.

Best results are achieved if the chosen angle is between 40° and 90°, preferably between 50° and 80°, most preferably between 60° and 70°.

It is of great advantage for rapid heat transfer if the elevations and/or depressions of at least one row are essentially flat-topped, preferably essentially parallel to the neighboring separating wall.

By making the bridges of each row essentially parallel and equally inclined relative to the separating walls the medium is directed towards the separating wall, resulting in good mixing and thus good heat transfer. Equal inclination of the bridges results in large opening cross-sections between individual rows, leading to small pressure drops and a homogeneous flow.

Manufacture of the turbulence generators is carried out in two steps:

The first step usually is a low-cost, process-stable rolling-stamping-process. In a second step the height of the turbulence generator and the horizontal shift of the elevations by the equally inclined bridges is adapted to the distance of the separating walls by a planishing tool. The openings between the individual rows are widened during this process.

It is of particular advantage that the height of the turbulence generator can be adapted to the given application. This permits optimum choice of parameters pressure drop, heat transfer performance and height of the device for diverse heat exchanger applications.

BRIEF DESCRIPTION OF THE DRAWINGS

The invention will now be described in more detail with reference to the enclosed drawings. There is shown in FIG. 1 a longitudinal section of a plate heat exchanger according to the invention.

DETAILED DESCRIPTION OF THE PREFERRED EMBODIMENT

Figure 1:
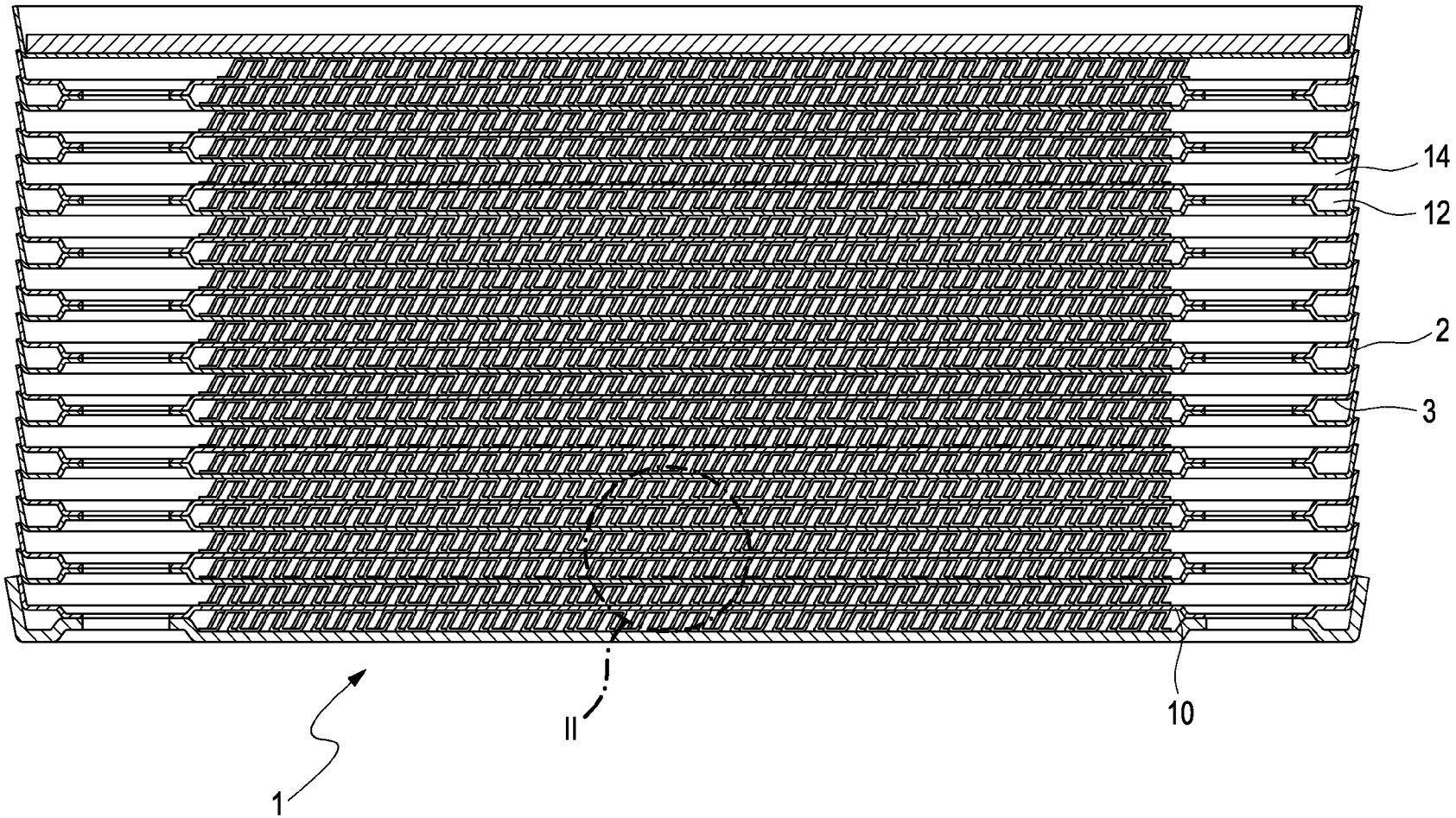
Figure 2:
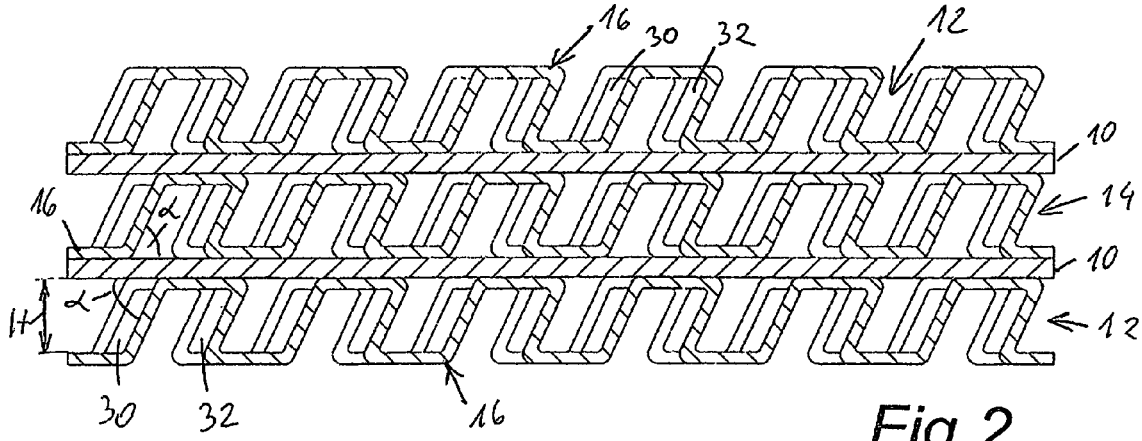
FIG. 2 detail II of the heat exchanger in sectional view.
Figure 3:
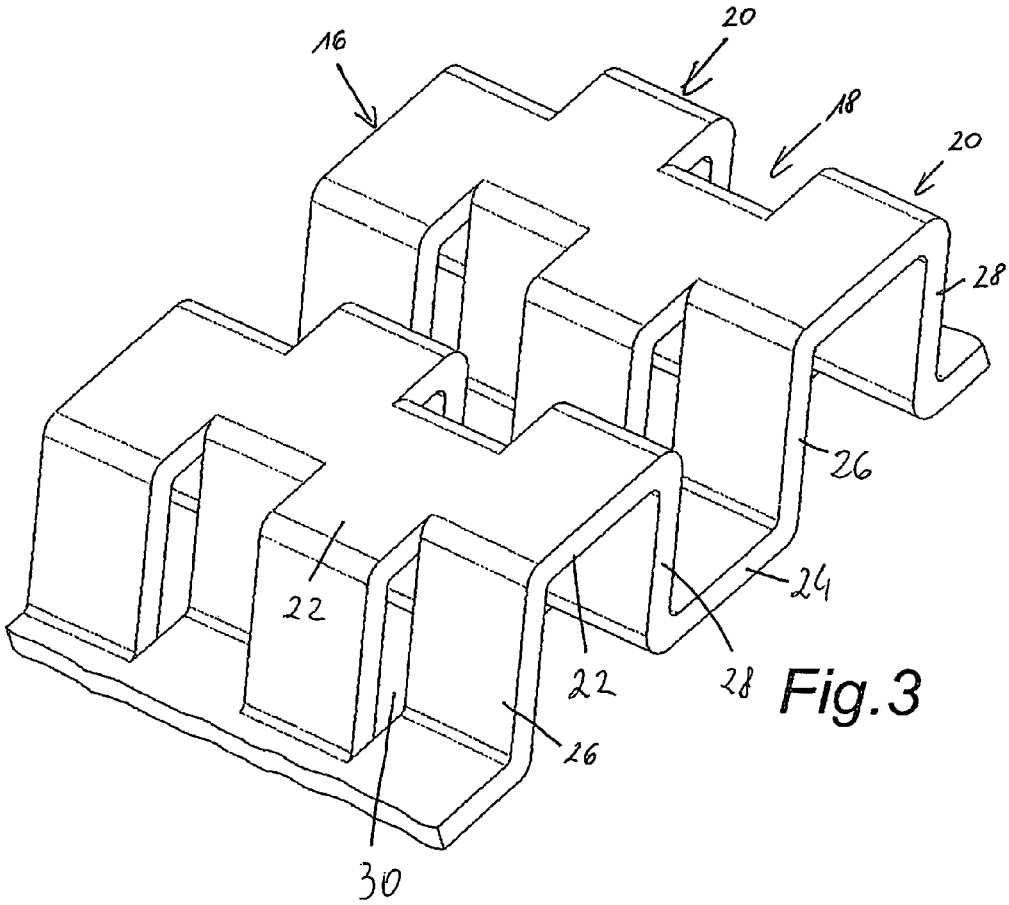
FIG. 3 a turbulence generator in an oblique view.

The plate heat exchanger 1 consists of a stack 2 of deep-drawn, trough-shaped sheet iron plates 3, the sheet iron plates 3 forming parallel, distanced separating walls 10. The separating walls 10 alternatingly define a first flow space 12 for a first medium and a second flow space 14 for a second medium. The first medium may for instance be oil, which is to be cooled, the second medium may be a coolant, e.g. water.

In the embodiment shown plate-shaped turbulence generators 16 are provided in the first flow space 12 as well as in the second flow space 14. Each turbulence generator 16 has a plurality of band-shaped rows 18, 20 lying side by side and having elevations 22 and depressions 24. The elevations 22 are linked to the depressions 24 by bridges 26, 28. Two immediately adjacent rows are shifted against each other, that is, elevations 22 and depressions 24 of one row 18 are staggered relative to those of each immediately adjacent row 20, 18. Each row 18 thus has a transition area 30, 32 between the two rows 18, 20 at each side wall 26, 28, such that the depressions 24 of each row 18, 20 are flow-connected with the elevations 22 of the neighboring row 20, 18.

The bridges 26, 28 of each row 18, 20 are essentially parallel to each other and equally inclined, with the bridges 26, 28 forming an angle $\alpha$ with the neighboring separating wall 10, which in the embodiment shown is approximately 60° to 70°. To ensure good heat transfer between turbulence generators 16 and separating walls 10, elevations 22 and depressions 24 are essentially flat, especially parallel to the separating walls 10. The turbulence generators 16 are brazed to the adjacent separating walls 10 in the area of elevations 22 and depressions 24.

Due to the equal inclination of the bridges 26, 28 large transition areas 30, 32 are provided between individual rows 18, 20, guaranteeing small pressure drop and homogeneous flow. The inclination of the bridges 26, 28 by the acute angle $\alpha$ furthermore causes a deflection of the medium towards the separating walls 10, resulting in good mixing and thus good heat transfer.

Manufacture of the turbulence generators 16 can be carried out in two steps. The first step usually is a low-cost, process-stable rolling-stamping-process. In a second step a defined height H and a certain horizontal shift of the elevations 22 relative to the depressions 24 is realised using a planishing tool. The transition openings 30, 32 between the individual rows are widened during this step. In this second process step the height H of the turbulence generator can be adjusted to the given application. This permits optimum adaptation of the parameters pressure drop, heat transfer performance and height of the device for diverse applications.

What is claimed is:

1. Plate heat exchanger with a plurality of separating walls stacked one above the other, which alternatingly define a first and second flow space for a first and second medium, with at least one turbulence generator being positioned in at least one flow space, said turbulence generator comprising a plate with a plurality of parallel-running band-like rows of alternating elevations and depressions mutually connected by bridges, where the elevations and depressions of each row are shifted with respect to each immediately adjacent row, and where each row is provided with at least one transition area for the medium to pass to an immediately adjacent row, such that the depressions of each row are flow-connected with immediately adjacent elevations of at least one immediately adjacent row, wherein adjacent bridges of the bridges of each row are essentially parallel and equally inclined relative to the separating walls, with an acute angle being formed between separating wall and bridges.

2. Plate heat exchanger according to claim 1, wherein the angle lies between 40° and 90°.

3. Plate heat exchanger according to claim 1, wherein the angle lies between 50° and 80°.

4. Plate heat exchanger according to claim 1, wherein the angle lies between 60° and 70°.

5. Plate heat exchanger according to claim 1, wherein the elevations and/or depressions of at least one row are essentially configured flat.

6. Plate heat exchanger according to claim 5, wherein the elevations and/or depressions of at least one row are configured essentially parallel to the adjacent separating wall.

7. Plate heat exchanger comprising a plurality of separating walls stacked one above the other, said separating walls defining a first flow space and second flow space for a first and second medium, said first and second flow spaces being alternatingly disposed with respect to one another;

at least one turbulence generator being disposed in at least one of said flow spaces, said turbulence generator including a plate with a plurality of parallel-running band-shaped rows of alternating elevations and depressions mutually connected by bridges, said elevations and depressions within each said row being shifted with respect to each immediately adjacent said row, each said row being provided with at least one transition area for the medium to pass to an immediately adjacent said row, said depressions of each row being flow-connected with immediately adjacent elevations of at least one immediately adjacent said row, adjacent bridges of said bridges within each said row being substantially parallel to one another and equally inclined relative to the separating walls.

* * * * *